US010271576B1

(12) United States Patent
Richardson

(10) Patent No.: US 10,271,576 B1
(45) Date of Patent: Apr. 30, 2019

(54) SMOKING PRODUCTS SUPPORT STRUCTURE

(71) Applicant: Steven Ellis Richardson, Tracy, CA (US)

(72) Inventor: Steven Ellis Richardson, Tracy, CA (US)

( * ) Notice: Subject to any disclaimer, the term of this patent is extended or adjusted under 35 U.S.C. 154(b) by 0 days.

(21) Appl. No.: 15/908,022

(22) Filed: Feb. 28, 2018

Related U.S. Application Data

(60) Provisional application No. 62/597,361, filed on Dec. 11, 2017, provisional application No. 62/591,595, filed on Nov. 28, 2017.

(51) Int. Cl.
*A24F 5/00* (2006.01)
*A24F 5/08* (2006.01)

(52) U.S. Cl.
CPC ..... *A24F 5/08* (2013.01)

(58) Field of Classification Search
CPC ..... A24F 5/00; A24F 5/06; A24F 5/08
USPC ..... 131/183, 224, 205
See application file for complete search history.

(56) References Cited

U.S. PATENT DOCUMENTS 2,052,237 A * 8/1936 McAllaster ..... A24F 5/08
131/183

* cited by examiner

*Primary Examiner* — Michael H. Wilson
*Assistant Examiner* — Dionne W. Mayes
(74) *Attorney, Agent, or Firm* — Gerald R. Prettyman

(57) ABSTRACT

Disclosed is an apparatus for supporting smoking products and ash in a smoking pipe to prevent smoking products and ash from passing from the bowl into an inner pipe chamber.

14 Claims, 9 Drawing Sheets

SMOKING PRODUCTS SUPPORT STRUCTURE

CROSS-REFERENCE TO RELATED APPLICATION

This application claims the benefit of priority of U.S. Provisional Patent Application 62/591,595 filed Nov. 28, 2017 and titled "SMOKING PEG," the disclosure of which is incorporated by reference, and of U.S. Provisional Patent Application 62/597,361 filed Dec. 11, 2017 and titled "SMOKING PEG WITH WIREFORM," the disclosure of which is incorporated by reference. This application is related to and claims the same inventive entity and ownership to U.S. Design patent application 29631634 filed Dec. 31, 2017 and titled "SMOKING PEG," the disclosure of which is incorporated by reference.

STATEMENT REGARDING FEDERALLY SPONSORED RESEARCH OR DEVELOPMENT

Not Applicable

BACKGROUND OF THE INVENTION

Field of Invention

The invention relates generally to the field of smoking pipes and more specifically to structures for supporting smoking products and ash in a pipe.

Description of Related Art

The passing of smoking products, ash and partially burned smoking products from beyond the confines of the smoking products and ash container, i.e., the bowl, can disrupt the pleasure of smoking as well as allow aspiration of waste smoking products.

SUMMARY OF THE INVENTION

Disclosed are embodiments for confining smoking products, ash and partially burned smoking products to the confines of the smoking products receptacle.

In some embodiments, an upper surface supports and restrains smoking products, ash and partially burned smoking products from passing beyond the confines of the smoking products and ash container. One or more tactically designed and placed passages in the upper surface permit the passage of smoke to pass into the pipe interior while assuring the non-passage of ash and partially burned smoking products. A tactically designed smoking product support structure holds the upper surface in place during use and cleaning.

In some embodiments, the smoking product support structure comprises one or more legs descending from a lower surface which is integrated into the upper surface. The legs have one of a set of strategic designs to bind the smoking peg in place during use and cleaning while assuring the smoking product support structure does not damage the pipe walls.

In some embodiments, the surface for supports and restrains smoking products, ash and partially burned smoking products from passing beyond the confines of the smoking products and ash container comprises one or more circular lobes.

DETAILED DESCRIPTION OF THE INVENTION

Disclosed are embodiments of an apparatus for supporting smoking products in a smoking pipe with a cross-sectional area sufficient to support and block the smoking products from entering further into the pipe and yet having an air passage of sufficient cross-sectional area to allow smoke of the smoking product to pass from the smoking product receptacle and then through the pipe.

Figure 1:
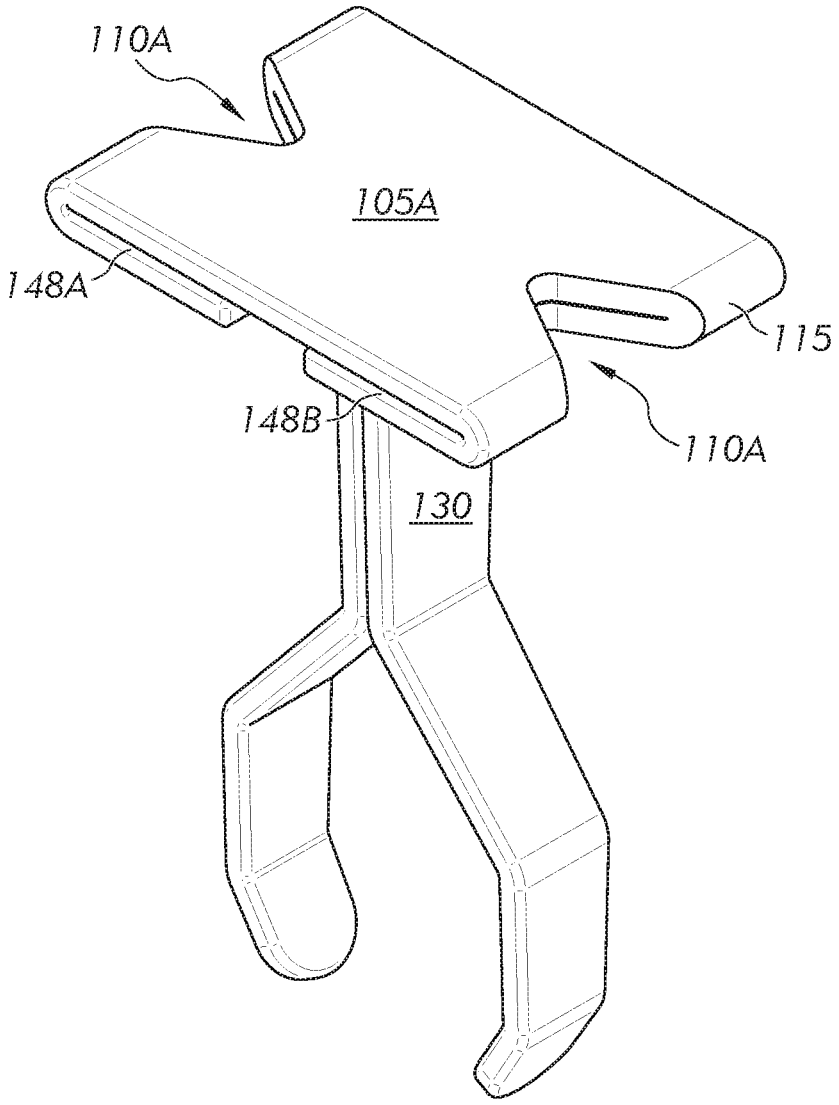
FIG. 1 shows an top oblique perspective view of a first example of a smoking product support structure (100).

FIG. 1 shows an top oblique perspective view of a first example of a smoking product support structure (100). Shown in FIG. 1 are a planar smoking product upper support (105A), an at least one air passage port (110A), an at least one semi-circular affixment (115), an at least one vertical leg (130), a first sandwich-edge left side (148A) and a first sandwich-edge right side (148B).

The smoking product support structure (100) may be made of any material compliant to block smoking products and ash from entering further into the pipe. The smoking product support structure (100) may be made integrally in the configuration shown, or may be manufactured via one or mores processes into the configuration shown. The processes may include molding, welding, soldering, or may including cutting and bending of sheet metal. In some embodiments, the smoking product support structure (100) may be made of glass, ceramics, a metal such as steel, stainless steel, aluminum, brass, copper, or iron, or other heat resistant material.

The planar smoking product upper support (105A) functions to support the smoking product in a smoking device such as a pipe. The planar smoking product upper support (105A) has a smoking product upper support surface area (105B) for this function. (See FIG. 3.) In a preferred embodiment, the planar smoking product upper support (105A) has a generally rectangular configuration.

An at least one air passage port (110A) allows smoke of the smoking product to pass from the smoking product receptacle and then through the pipe. To assure proper flow of smoke from the smoking product into the pipe, the at least one air passage port (110A) has an air passage port cross-section (110B). (See FIG. 3.)

An at least one semi-circular affixment (115) connects the planar smoking product upper support (105A) to a smoking product lower support (120). See FIG. 2.

An at least one vertical leg (130) provides stability and positioning of the smoking product support structure (100) within a smoking product receptacle. The disclosure below elaborates on these structures.

A first sandwich-edge left side (148A) and a first sandwich-edge right side (148B) provide indication that the planar smoking product upper support (105A) and the smoking product lower support (120) have proper alignment. In a typical embodiment, the first sandwich-edge left side (148A) is co-linear to the first sandwich-edge right side (148B). The first sandwich-edge left side (148A) and the first sandwich-edge right side (148B) appear parallel to the planar smoking product upper support (105A), thus giving a 'sandwich' appearance to the first sandwich-edge left side (148A) and the first sandwich-edge right side (148B).

Figure 2:
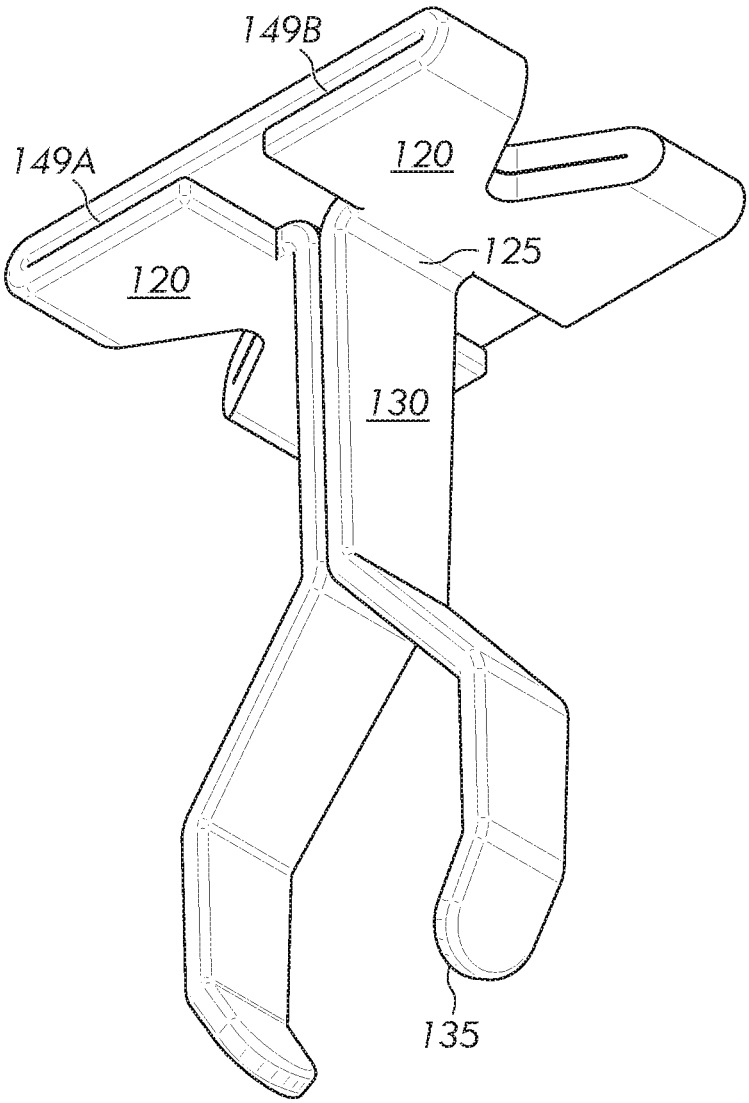
FIG. 2 shows an inverted view of FIG. 1

FIG. 2 shows an inverted view of FIG. 1. Shown in FIG. 2 are a smoking product lower support (120), an at least one angled affixment (125), the at least one vertical leg (130), a second sandwich-edge left side (149A), and a second sandwich-edge right side (149B).

An at least one angled affixment (125) connects the smoking product lower support (120) to the at least one vertical leg (130). The term angled is not meant to be an exact angle, but rather to designate a transition from the planar smoking product upper support (105A) to the at least one vertical leg (130).

In a typical embodiment, the at least one vertical leg (130) projects at an angle of 80 degrees to 100 degrees away from the planar smoking product upper support (105A) and the smoking product lower support (120). In some embodiments, the at least one vertical leg (130) projects at an angle of 60 degrees to but not including 80 degrees away from the planar smoking product upper support (105A). In some embodiments, the at least one vertical leg (130) projects at an angle of at least 100 degrees up to and including 120 degrees away from the planar smoking product upper support (105A).

As with the first sandwich-edge left side (148A) and the first sandwich-edge right side (148B), the second sandwich-edge left side (149A) and the second sandwich-edge right side (149B) provide indication that the planar smoking product upper support (105A) and the smoking product lower support (120) have proper alignment. In a typical embodiment, the second sandwich-edge left side (149A) is co-linear to the second sandwich-edge right side (149B). The second sandwich-edge left side (149A) and the second sandwich-edge right side (149B) appear parallel to the planar smoking product upper support (105A), thus giving a 'sandwich' appearance to the planar smoking product upper support (105A) and the smoking product lower support (120).

Consequently, in a typical embodiment, the planar smoking product upper support (105A) and the smoking product lower support (120) are parallel to each other.

Figure 3:
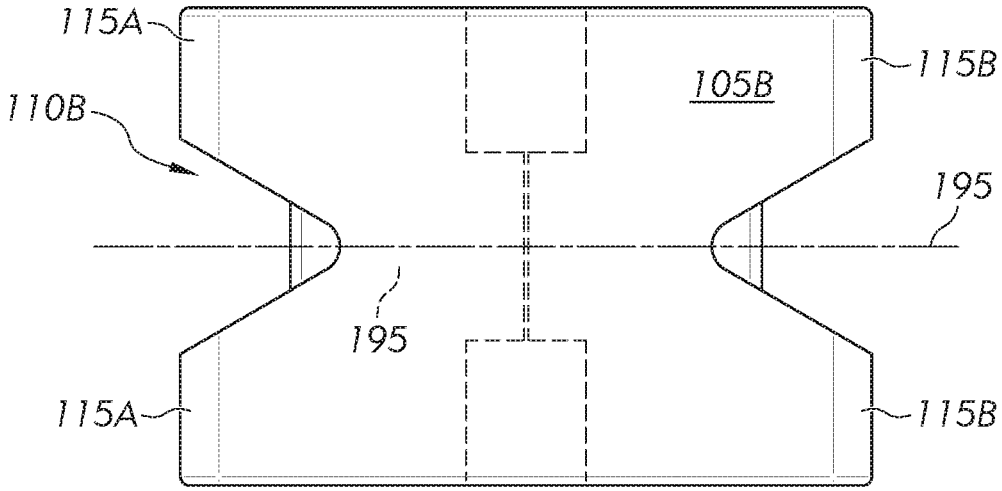
FIG. 3 shows a top view of a smoking product support structure (100).

FIG. 3 shows a top view of a smoking product support structure (100). Shown in FIG. 3 are the planar smoking product upper support (105A), the smoking product upper support surface area (105B) of the planar smoking product upper support (105A), an air passage port cross-section (110B) of an at least one air passage port (110A), a first semi-circular affixment side (115A), a second semi-circular affixment side (115B) and a smoking product upper support bisecting line (195). Also shown in FIG. 3 through the at least one air passage port (110A) are a portion of an at least one vertical leg (130) below the planar smoking product upper support (105A).

As shown in FIG. 3, the planar smoking product upper support (105A) has a planar appearance. In one embodiment, the smoking product upper support surface area (105B) of the planar smoking product upper support (105A) measures approximately 30 square millimeters.

In some embodiments, the planar smoking product upper support (105A) comprises two parallel edges. One of the parallel edges being the first sandwich-edge left side (148A) and the first sandwich-edge right side (148B) (as shown in FIG. 1), and the second parallel edge being the second sandwich-edge left side (149A) and the second sandwich-edge right side (149B) (as shown in FIG. 2).

In a typical embodiment, there are additionally two other sides which are with at least one side having the at least one semi-circular affixment (115) and which are perpendicular to the sandwich-edge sides. These sides are a first semi-circular affixment side (115A) between the first sandwich-edge left side (148A), and the second sandwich-edge right side (149B), and a second semi-circular affixment side (115B) opposite the first semi-circular affixment side (115A) and between the first sandwich-edge right side (148B) and the second sandwich-edge left side (149A).

As shown in FIG. 3 for a typical embodiment, the at least one air passage port (110A) has a configuration of a triangular notch in the at least one semi-circular affixment (115). In one embodiment, the air passage port cross-section (110B) of the at least one air passage port (110A) measures about 2 square millimeters. In an embodiment in which the smoking product upper support surface area (105B) of the planar smoking product upper support (105A) measures approximately 30 square millimeters and the air passage port cross-section (110B) of the at least one air passage port (110A) measures about 2 square millimeters, the air passage port cross-section (110B) of the at least one air passage port (110A) measures at least 5 percent of the area of the smoking product upper support surface area (105B) of the planar smoking product upper support (105A). In some embodiments, the air passage port cross-section (110B) of the at least one air passage port (110A) may measure over 10 percent of the area of the smoking product upper support surface area (105B) of the planar smoking product upper support (105A).

As shown and defined, a smoking product upper support bisecting line (195) bisects the planar smoking product upper support (105A) and the smoking product upper support surface area (105B) into two equal areas. In some embodiments, each of the at least one air passage port (110A) would bisect the first semi-circular affixment side (115A) or the second semi-circular affixment side (115B) into two equally sized halves.

Figure 4:
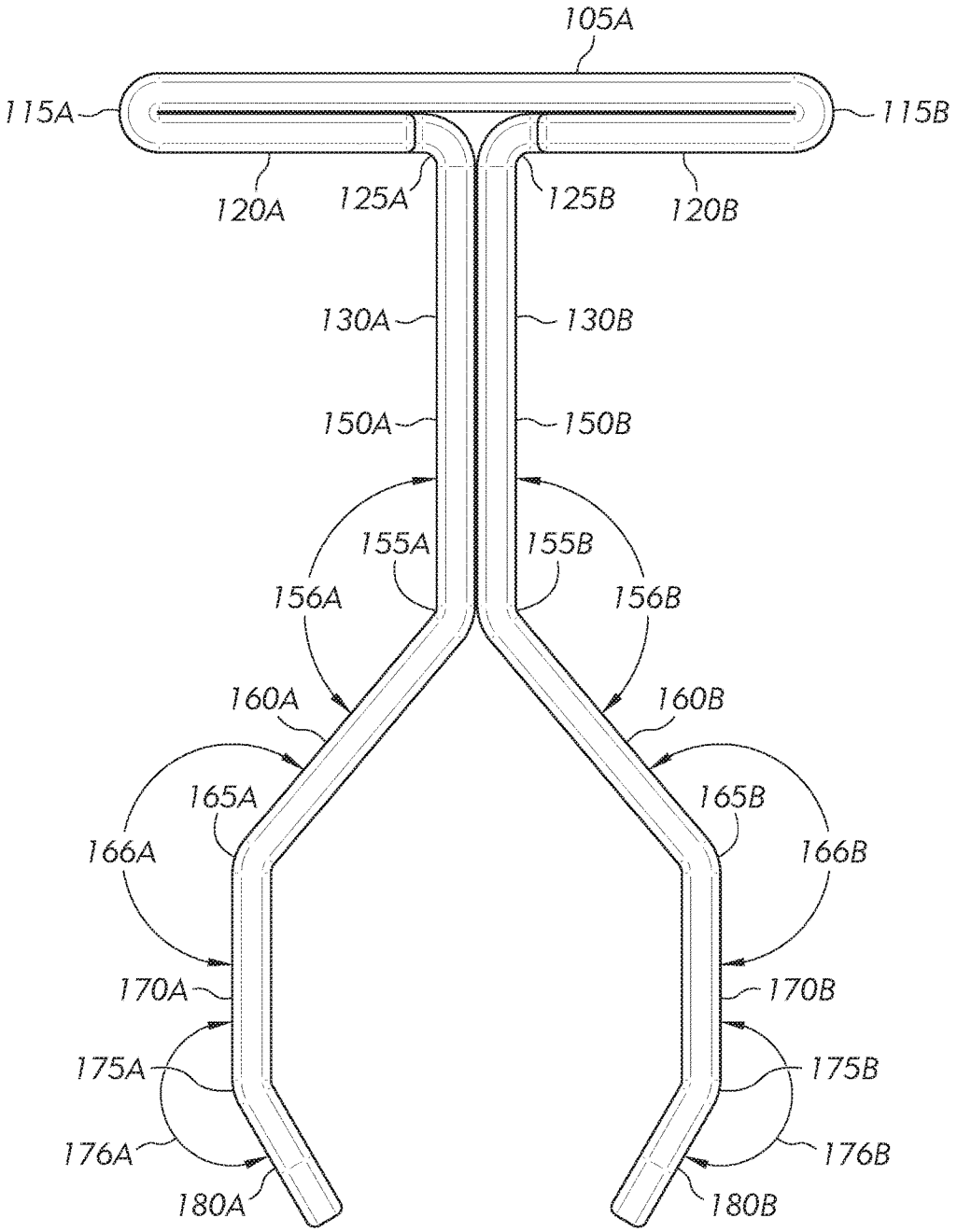
FIG. 4 shows a front view of a smoking product support structure (100).

FIG. 4 shows a front view of a smoking product support structure (100). In a typical smoking product support structure (100), a front view of a smoking product support structure (100) is a mirror image of a back view, if not identical views. In addition, a designation of "A" or "B" is not an absolute reference (except 105A and 105B), such that a designation of "A" may be swapped for "B," or "B" for "A" without meaningful affect. Likewise, a designation of "first side" or "second side" may be swapped for "second side" or "first side," except in the instance where "first" or "second" denote serialization, as with the leg bends and leg sections.

Shown in FIG. 4 are a side view of the planar smoking product upper support (105A) along with (but not indicated) a left sandwich edge and a right sandwich edge. (As the left and right views are mirror images, if not identical views, identification of the left sandwich edge and a right sandwich edge as 'first' or 'second' is not relevant, though for reference to the features below, the edges may be thought of as the first sandwich edge side.)

In this embodiment having a first semi-circular affixment side (115A) and a second semi-circular affixment side (115B), this embodiment bifurcates the smoking product lower support (120) into two halves. Extending from the first semi-circular affixment side (115A) and comprising one half of the smoking product lower support (120) is the smoking product lower support first side (120A). Similarly, extending from the second semi-circular affixment side (115B) and comprising one half of the smoking product lower support (120) is the smoking product lower support second side (120B).

Consequently, FIG. 4 shows a first angled affixment (125A) and second angled affixment (125B), as wells as two of the at least one vertical leg (130) which are identified as a first side vertical leg (130A) and a second side vertical leg (130B).

As indicated by FIG. 4, each of the first side vertical leg (130A) and the second side vertical leg (130B) comprise multiple elements for securing the smoking product support structure (100) into a smoking product receptacle. Among these elements are a plurality of leg portions and bends which allow the smoking product support structure (100) to closely conform in outline to the throat of the pipe bowl to secure the smoking product support structure (100) within the smoking pipe.

The first side vertical leg (130A) projects from a first angled affixment (125A) of the smoking product lower support first side (120A). The first side vertical leg (130A) comprises a first side leg first leg section (150A) projecting perpendicular from the smoking product lower support first side (120A).

The second side vertical leg (130B) projects from a second angled bend of the smoking product lower support second side (120B). The second side vertical leg (130B) comprises a second side leg first leg section (150B) projecting perpendicular from the smoking product lower support second side (120B).

Consequently, the first side leg first leg section (150A) is parallel to the second side leg first leg section (150B). In addition, the first side leg first leg section (150A) is equal in length to the second side leg first leg section (150B).

Thus, the first side vertical leg (130A) and the second side vertical leg (130B) are perpendicular to the planar smoking product upper support (105A) and parallel to each other. This configuration provides the smoking product support structure (100) with consistent insertion into a pipe.

Continuing down at least one vertical leg (130), the first side vertical leg (130A) further comprises a first side leg first bend (155A) projecting from the first side leg first leg section (150A) and having a first side leg first angle (156A), with a first side leg second leg section (160A) projecting from the first side leg first bend (155A).

Similarly the second side vertical leg (130B) further comprises a second side leg first bend (155B) projecting from the second side leg first leg section (150B) having second side leg first angle (156B), with a second side leg second leg section (160B) projecting from the second side leg first bend (155B).

While the first side leg first leg section (150A) is parallel to the second side leg first leg section (150B), the first side leg second leg section (160A) diverges from to the second side leg second leg section (160B). This feature aids the smoking product support structure (100) with securing itself within a smoking pipe.

In the typical embodiment of a smoking product support structure (100), the first side leg first angle (156A) has an angle equal in angle to the second side leg first angle (156B) and the length of the first side leg first leg section (150A) is equal in length to the second side leg first leg section (150B).

In some examples, the first side leg first angle (156A) has an angle not equal in angle to the second side leg first angle (156B). In some examples, the length of the first side leg first leg section (150A) not is equal in length to the second side leg first leg section (150B).

Projecting from the first side leg second bend (165A) is a first side leg third leg section (170A). Similarly, projecting from the second side leg second bend (165B) is a second side leg third leg section (170B). Unlike the prior sections to which they are attached, the first side leg third leg section (170A) is parallel to the second side leg third leg section (170B) in addition to the first side leg third leg section (170A) having a length equal to the second side leg third leg section (170B).

In this configuration, the first side leg third leg section (170A) and the second side leg third leg section (170B) serve as detents against a narrowed underside of a smoking product receptacle and hold the smoking product support structure (100) in place, even when the pipe has an inverted configuration.

In addition, the first side leg third leg section (170A) is parallel to the first side leg first leg section (150A) and the second side leg third leg section (170B) is parallel to the second side leg first leg section (150B). Consequently, the first side leg first angle (156A) and the first side leg second angle (166A) are angularly supplementary to each other.

Projecting from the first side leg third leg section (170A) is a first side leg third bend (175A), which has a first side leg third angle (176A). Similarly, projecting from the second side leg third leg section (170B) is a second side leg third bend (175B), which has a second side leg third angle (176B).

Projecting from the first side leg third bend (175A) is a first side leg fourth leg section (180A). Projecting from the second side leg third bend (175B) is a second side leg fourth leg section (180B). The first side leg third angle (176A) and the second side leg third angle (176B) are acute and equal angles, such that the first side leg fourth leg section (180A) and the second side leg fourth leg section (180B) converge towards each other.

When used with a smoking pipe which has a bowl throat height between the distance from the underside of the smoking product lower support (120) to the first side leg second angle (166A), the smoking product support structure (100) secures itself within the throat of the smoking pipe. (See FIG. 8A.) This converging configuration provides the smoking product support structure (100) with easy insertion into a throat of the pipe bowl.

Figure 5:
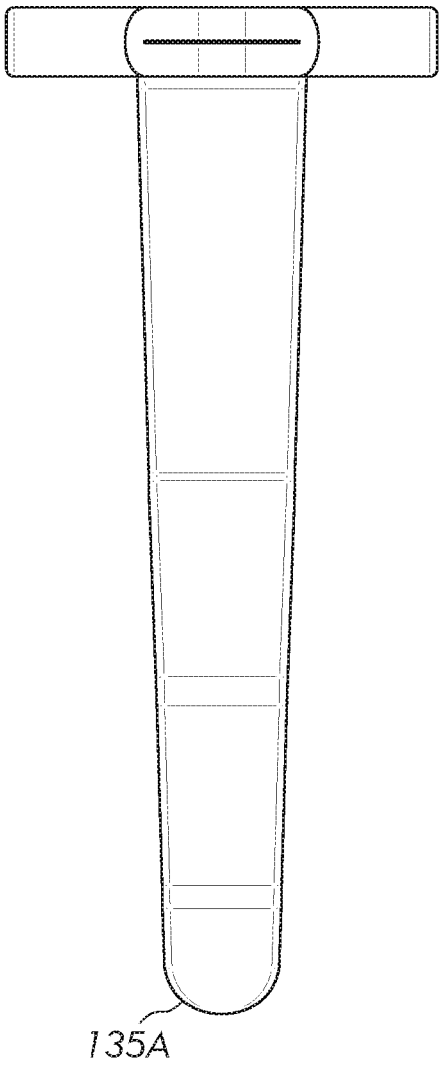
FIG. 5 shows one example of a terminating tip (135) of the at least one vertical leg (130).

FIG. 5 shows one example of a terminating tip (135) of the at least one vertical leg (130). In some examples, the terminating tip (135) of the at least one vertical leg (130) comprises a rounded edge (135A).

Figure 6:
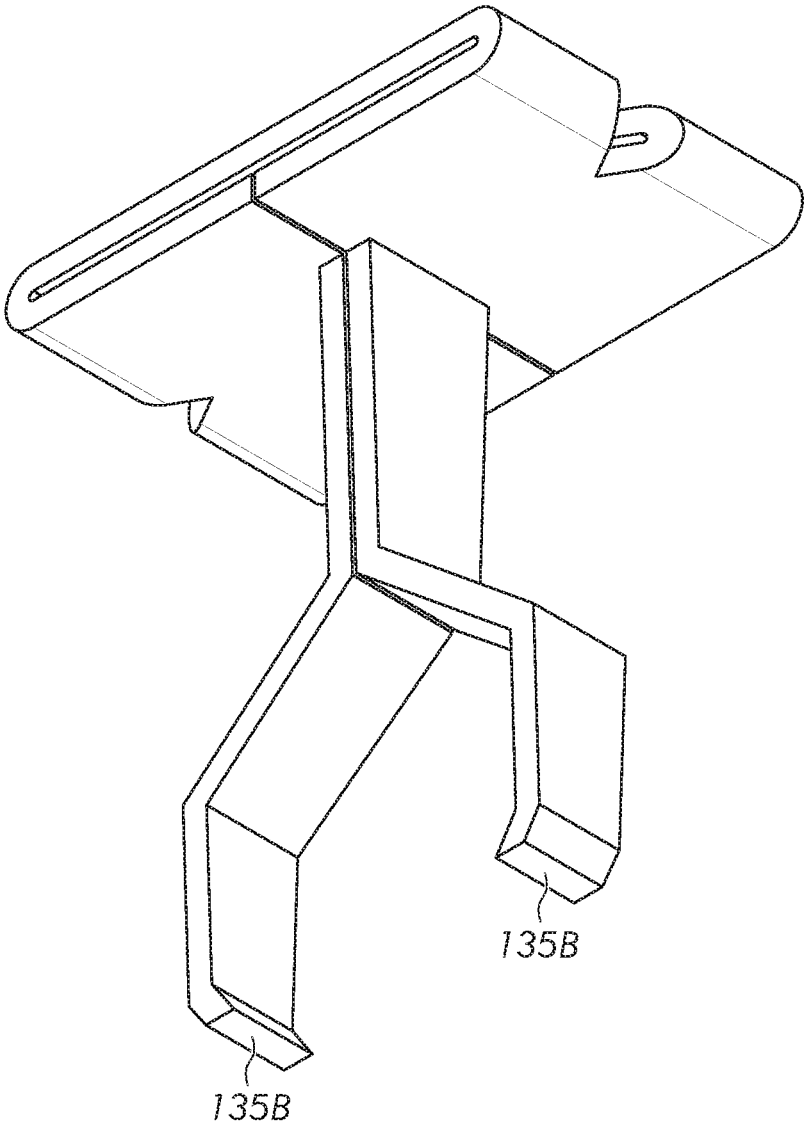
FIG. 6 shows another example of a terminating tip (135) of the at least one vertical leg (130).

FIG. 6 shows another example of a terminating tip (135) of the at least one vertical leg (130). In some examples, the terminating tip (135) of the at least one vertical leg (130) comprises a non-rounded edge (135B).

Figure 7:
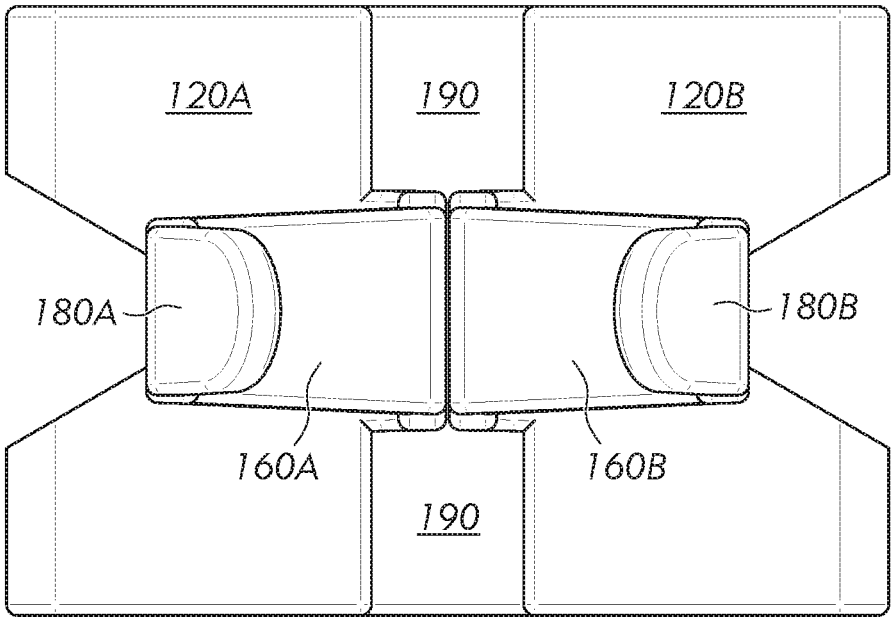
FIG. 7 shows a bottom view of a smoking product support structure (100).

FIG. 7 shows a bottom view of a smoking product support structure (100). Shown in FIG. 7 are the smoking product lower support first side (120A), the smoking product lower support second side (120B), the underside of the first side leg second leg section (160A) and the second side leg second leg section (160B), the underside of the first side leg fourth leg section (180A) and second side leg fourth leg section (180B), and a smoking product lower support spacing (190).

As shown in FIG. 7 for this example of a smoking product support structure (100), the smoking product lower support first side (120A) and the smoking product lower support second side (120B) do not share a common underside edge at the at least one vertical leg. There is rather, a smoking product lower support spacing (190) between them. In a typical embodiment of a smoking product support structure (100), a smoking product lower support spacing (190) has a width equal to the combined widths of the first side vertical leg (130A) plus the second side vertical leg (130B) and the width of the first angled affixment (125A) and second angled affixment (125B).

Figure 8A:
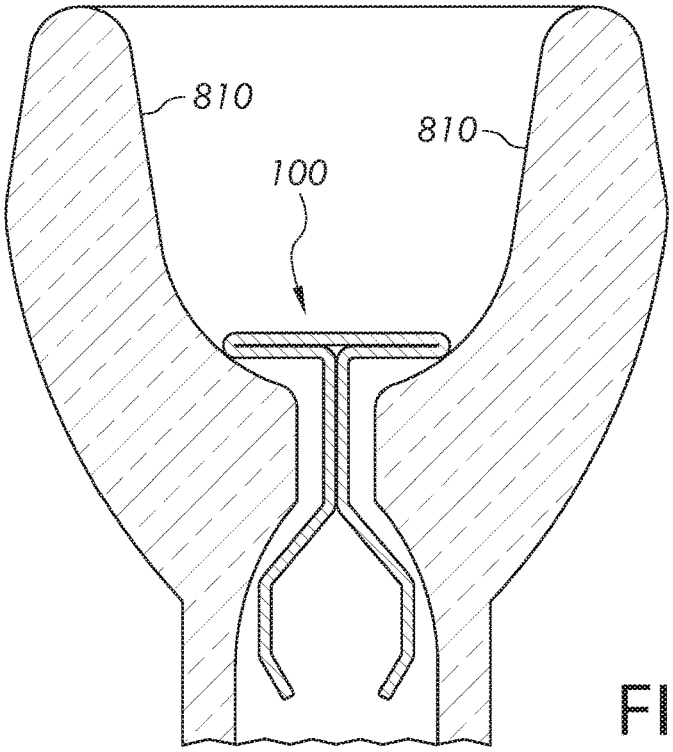
FIG. 8A and FIG. 8B show a typical smoking product support structure (100) in place in a smoking product receptacle (810).
Figure 8B:
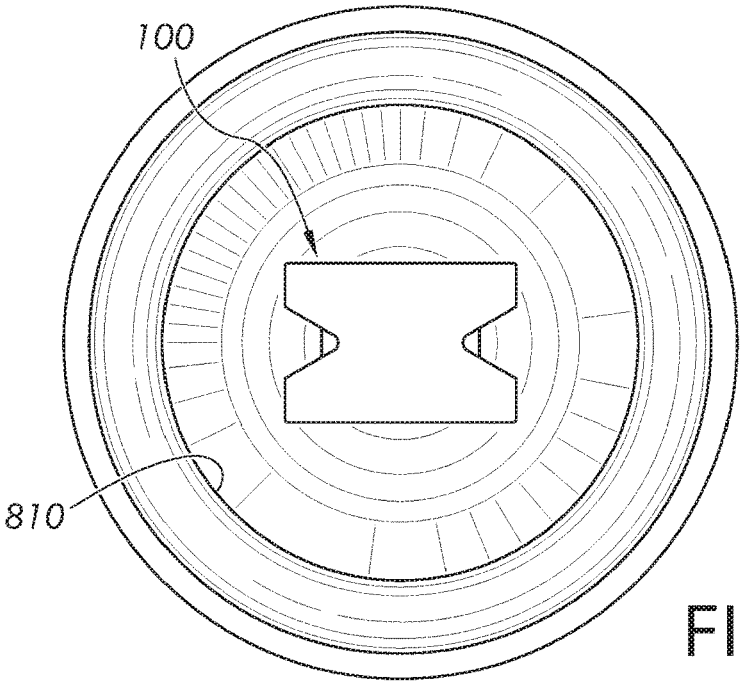
Figure 9A:
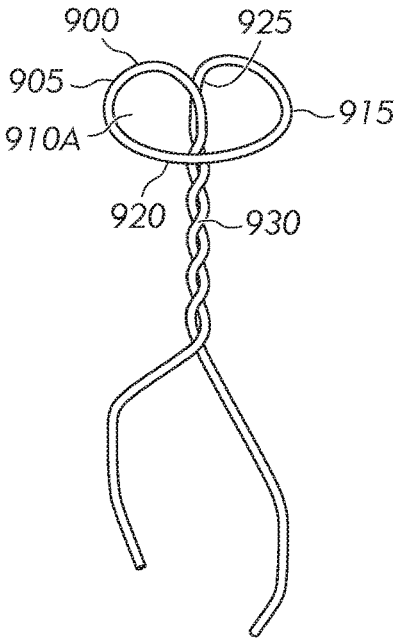
FIGS. 9A, 9B, 9C and 9D show an alternate embodiment of the smoking product support structure (900).
Figure 9B:
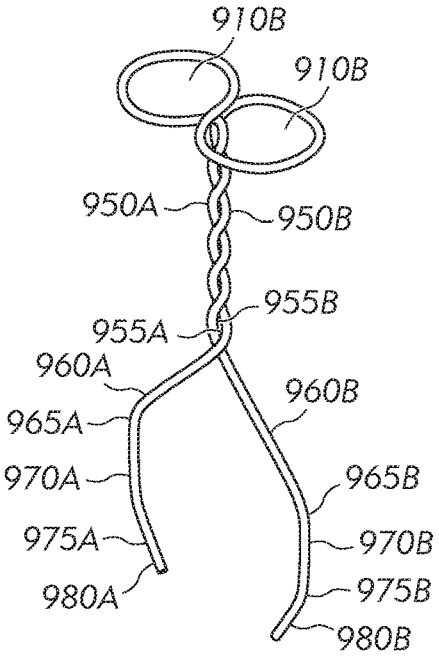
Figure 9C:
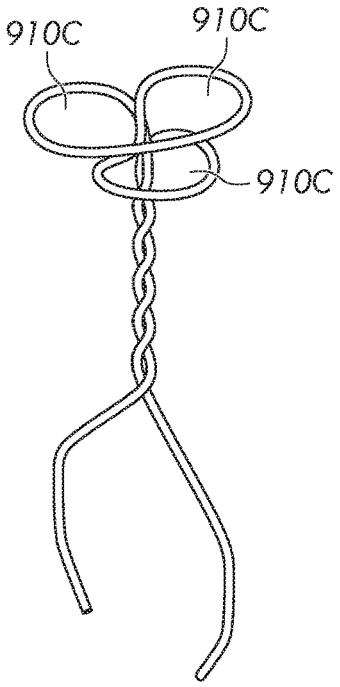
Figure 9D:
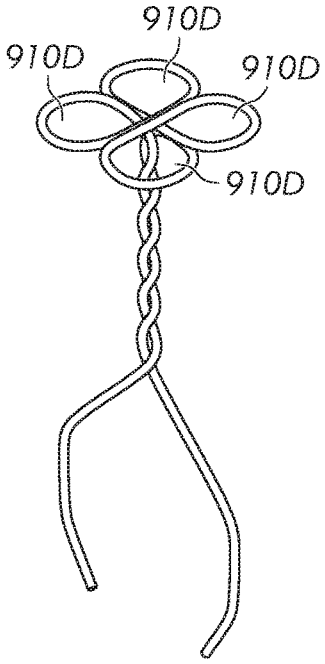

FIG. 8A and FIG. 8B show a smoking product support structure (100) in place in a smoking product receptacle (810). As described above, the at least one vertical leg (130), first side vertical leg (130A) or second side vertical leg (130B) extends past the smoking product receptacle into the throat below the smoking product receptacle. With the divergent legs of the smoking product support structure (100) being larger than the throat below the smoking product receptacle, the smoking product support structure (100) tends to stay within the smoking product receptacle, even when the smoking product receptacle has an inverted configuration.

FIGS. 9A, 9B, 9C and 9D show an alternate embodiment of the smoking product support structure (900).

Shown in FIGS. 9A, 9B, 9C and 9D are a wire (900), a smoking product support section (905), an at least one circular lobe (910A), an at least one semi-circular affixment (915), a smoking product lower support (920), an at least one angled affixment (925), a twisted wire vertical leg (930) comprising a proximal twisted section (950A), and a distal twisted section (950B), a non-twisted proximal first bend (955A), a non-twisted distal first bend (955B), a non-twisted proximal first leg section (960A), a non-twisted distal first leg section (960B), a non-twisted proximal second bend (965A), a non-twisted distal second bend (965B), a non-twisted proximal second leg section (970A), a non-twisted distal second leg section (970B), a non-twisted proximal third bend (975A), a non-twisted distal third bend (975B), a non-twisted proximal third leg section (980A), and a non-twisted distal third leg section (980B).

In these embodiments, the smoking product support structure is made of a wire (900) and has structures comparable to the first disclosed form. As with the smoking product support structure (100), the alternate embodiment of the smoking product support structure (900) may be made of a metal such as steel, stainless steel, aluminum, brass, copper, or iron, or other heat resistant material. Some embodiments of the alternate embodiment of the smoking product support structure (900) may incorporate more than one material, such as a ceramic or alloys of metals.

There is for example, a smoking product support section (905) that has at least one circular lobe (910A) serving as an at least one air passage port, while the wire (900) has an at least one semi-circular affixment (915), i.e., presuming the wire is solid and round, connecting a smoking product lower support (920) to the smoking product support section (905) which serves as the planar smoking product upper support (105A).

In some embodiments, the at least one semi-circular affixment (915) might not be semi-circular, as might be with wire pulled in another configuration, such as flat, triangular, square, five-sided, six-sides, etc.

The smoking product support structure (900) may be designated to have a proximal end and a distal end. The designation may be arbitrary.

In embodiments designated to have a proximal end and a distal end, there is an at least one angled affixment (925) connecting the smoking product support section (905) to the twisted wire vertical leg (930). The term angled is not meant to be an exact angle, but rather to designate an angular transition from the smoking product support section (905) to the twisted wire vertical leg (930).

Comprising the twisted wire vertical leg (930) are a proximal twisted section (950A) and a distal twisted section (950B). The proximal twisted section (950A) and the distal twisted section (950B) are twisted together to form a twisted wire vertical leg (930) extending from the smoking product support section (905) and affix the smoking product support section (905) and provides height and structure to hold the smoking product support structure (900) in position above the holding structure, described below.

To hold the smoking product support structure (900) in place, the twisted wires untwist to form a non-twisted proximal first bend (955A) and a non-twisted distal first bend (955B), which then separate the proximal twisted section (950A) from the distal twisted section (950B) into a non-twisted proximal first leg section (960A) and a non-twisted distal first leg section (960B).

The non-twisted proximal first bend (955A) and the non-twisted distal first bend (955B) are acute angles so that the non-twisted proximal first leg section (960A) and the non-twisted distal first leg section (960B) extend away from each other and from the planar smoking product upper support (105A).

Extending from the non-twisted proximal first bend (955A) and the non-twisted distal first bend (955B) are a non-twisted proximal second leg section (970A), and a non-twisted distal second leg section (970B). As with the smoking product support structure (100), these leg sections extend vertically, but may not be parallel to each other.

Extending from the non-twisted proximal second leg section (970A), and the non-twisted distal second leg section (970B) are a non-twisted proximal third bend (975A) and a non-twisted distal third bend (975B). As with the smoking product support structure (100), these bends are obtuse so that the leg sections extending from the non-twisted proximal third bend (975A) and the non-twisted distal third bend (975B) extend towards each other.

Extending from the non-twisted proximal third bend (975A) and the non-twisted distal third bend (975B) are a non-twisted proximal third leg section (980A) and a non-twisted distal third leg section (980B). The non-twisted proximal third leg section (980A) and the non-twisted distal third leg section (980B) extend towards each other to provide easier insertion into a pipe.

In some embodiments, the at least one circular lobe (910A) comprises two circular lobes (910B). In some embodiments, the at least one circular lobe (910A) comprises three circular lobes (910C). In some embodiments, the at least one circular lobe (910A) comprises four circular lobes (910D).

These descriptions and drawings are embodiments and teachings of the disclosure. All variations are within the spirit and scope of the disclosure. This disclosure is not to be considered as limiting the claims to only the embodiments illustrated or discussed. Certain changes can be made in the subject matter without departing from the spirit and the scope of this invention. It is realized that changes are possible within the scope of this invention and it is further intended that each structure or element recited in any of the claims is to be understood as referring to all equivalent structure or elements. The following claims are intended to cover the invention as broadly as possible in whatever form it may be used.

What is claimed is:

1. A smoking product support structure (100) comprising a planar smoking product upper support (105A), an at least one air passage port (110A), an at least one semi-circular affixment (115) connecting a smoking product lower support (120) to the planar smoking product upper support (105A), and an at least one angled affixment (125) connecting an at least one vertical leg (130) to the smoking product lower support (120), wherein the at least one vertical leg (130) is configured to pass through a pipe draught hole and secure the planar smoking product upper support (105A) within a pipe bowl, wherein the planar smoking product upper support (105A) and the smoking product lower support (120) are parallel to each other, the at least one semi-circular affixment (115) comprises a first semi-circular affixment side (115A) parallel to a second semi-circular affixment side (115B), and the smoking product support structure (100) further comprises a first sandwich-edge left side (148A) co-linear to a first sandwich-edge right side (148B), wherein the first sandwich-edge left side (148A) and the first sandwich-edge right side (148B) are perpendicular to the first semi-circular affixment side (115A) and to the second semi-circular affixment side (115B), and a second sandwich-edge left side (149A) co-linear to a second sandwich-edge right side (149B), wherein the second sandwich-edge left side (149A) and the second sandwich-edge right side (149B) are perpendicular to the first semi-circular affixment side (115A) and to the second semi-circular affixment side (115B).

2. The smoking product support structure (100) of claim 1 wherein the smoking product lower support (120) comprises a smoking product lower support first side (120A) extending under the planar smoking product upper support (105A) from the first semi-circular affixment side (115A) and a smoking product lower support second side (120B) extending under the planar smoking product upper support (105A) from the second semi-circular affixment side (115B).

3. The smoking product support structure (100) of claim 2 wherein the smoking product lower support first side (120A) further comprises a first side vertical leg (130A) wherein the first side vertical leg (130A) comprises a first side leg first leg section (150A) projecting perpendicular from the smoking product lower support first side (120A), the smoking product lower support second side (120B) further comprises a second side vertical leg (130B) wherein the second side vertical leg (130B) comprises a second side leg first leg section (150B) projecting perpendicular from the smoking product lower support second side (120B), and the first side leg first leg section (150A) is parallel to and equal in length to the second side leg first leg section (150B).

4. The smoking product support structure (100) of claim 3 wherein the first side vertical leg (130A) further comprises a first side leg first bend (155A) projecting from the first side leg first leg section (150A) and having a first side leg first angle (156A), with a first side leg second leg section (160A) projecting from the first side leg first bend (155A), the second side vertical leg (130B) further comprises a second side leg first bend (155B) projecting from the second side leg first leg section (150B) and having second side leg first angle (156B), with a second side leg second leg section (160B) projecting from the second side leg first bend (155B) wherein the first side leg first angle (156A) equals the second side leg first angle (156B) and the first side leg second leg section (160A) diverges from and has a length equal to the second side leg second leg section (160B).

5. The smoking product support structure (100) of claim 4 wherein the first side vertical leg (130A) further comprises a first side leg second bend (165A) projecting from the first side leg second leg section (160A) and having a first side leg second angle (166A), with a first side leg third leg section (170A) projecting from the first side leg second bend (165A), the second side vertical leg (130B) further comprises a second side leg second bend (165B) projecting from the second side leg second leg section (160B) and having a second side leg second angle (166B), with a second side leg third leg section (170B) projecting from the second side leg second bend (165B), wherein the first side leg second angle (166A) equals the second side leg second angle (166B), and the first side leg third leg section (170A) is parallel and has a length equal to the second side leg third leg section (170B).

6. The smoking product support structure (100) of claim 5 wherein the first side vertical leg (130A) further comprises a first side leg third bend (175A) projecting from the first side leg third leg section (170A) and having a first side leg third angle (176A), with a first side leg fourth leg section (180A) projecting from the first side leg third bend (175A), the second side vertical leg (130B) further comprises a second side leg third bend (175B) projecting from the second side leg third leg section (170B) and having a second side leg third angle (176B), with a second side leg fourth leg section (180B) projecting from the second side leg third bend (175B) wherein the first side leg third angle (176A) equals the second side leg third angle (176B), and the first side leg fourth leg section (180A) converges towards the second side leg fourth leg section (180B).

7. The smoking product support structure (100) of claim 5 wherein the first side leg first angle (156A) and the first side leg second angle (166A) are angularly supplementary to each other.

8. The smoking product support structure (100) of claim 1 wherein the at least one vertical leg (130) further comprises a terminating tip (135).

9. The smoking product support structure (100) of claim 8 wherein the terminating tip (135) of the at least one vertical leg (130) comprises a rounded edge (135A).

10. The smoking product support structure (100) of claim 8 wherein the terminating tip (135) of the at least one vertical leg (130) comprises a non-rounded edge (135B).

11. The smoking product support structure (100) of claim 1 wherein the at least one air passage port (110A) comprises an at least one triangular notch in the first semi-circular affixment side (115A).

12. The smoking product support structure (100) of claim 1 wherein the at least one air passage port (110A) comprises an at least one air passage port cross-section (110B) of at least 5 percent of an smoking product upper support surface area (105B).

13. The smoking product support structure (100) of claim 12 wherein the at least one air passage port (110A) bisects the first semi-circular affixment side (115A) into two equally sized halves.

14. The smoking product support structure (100) of claim 1 wherein the at least one air passage port (110A) bisects the second semi-circular affixment side (115B) into two equally sized halves.

* * * * *